US006305385B1

(12) United States Patent
Szekely

(10) Patent No.: US 6,305,385 B1
(45) Date of Patent: Oct. 23, 2001

(54) COSMETIC DISPENSER

(75) Inventor: Alex Szekely, Jackson, NJ (US)

(73) Assignee: The Plastek Group, Erie, PA (US)

( * ) Notice: Subject to any disclaimer, the term of this patent is extended or adjusted under 35 U.S.C. 154(b) by 0 days.

(21) Appl. No.: 09/478,869

(22) Filed: Jan. 7, 2000

(51) Int. Cl.[7] ..... A45D 40/26; A46B 11/00

(52) U.S. Cl. ..... 132/218; 132/320; 401/122; 401/129; 401/126

(58) Field of Search ..... 132/218, 320, 132/317, 318, 313; 401/122, 129, 126

(56) References Cited

U.S. PATENT DOCUMENTS

| | | | | |
|---|---|---|---|---|
| D. 322,516 | | 12/1991 | Korper | D19/48 |
| D. 363,374 | | 10/1995 | Arnsten | D4/116 |
| 2,348,515 | | 5/1944 | Baumgartner | 132/218 |
| 2,625,159 | | 1/1953 | Roehrich | 132/218 |
| 3,130,735 | | 4/1964 | Clark | 132/218 |
| 3,214,782 | | 11/1965 | Masters et al. | 132/218 |
| 3,351,074 | | 11/1967 | Aston | 132/218 |
| 3,363,635 | | 1/1968 | Wurmbock | 132/218 |
| 3,896,823 | | 7/1975 | Spatz | 132/85 |
| 4,194,848 | * | 3/1980 | Kingsford | 401/5 |
| 4,403,624 | | 9/1983 | Montgomery | 132/218 |
| 4,411,282 | | 10/1983 | Wavering | 132/218 |
| 4,810,122 | * | 3/1989 | Cole | 401/122 |
| 4,961,665 | | 10/1990 | Fitjer | 401/129 |
| 5,188,131 | | 2/1993 | Toll | 132/218 |
| 5,283,061 | | 2/1994 | Kamen et al. | 424/400 |
| 5,349,972 | | 9/1994 | Dirksing et al. | 132/218 |
| 5,722,436 | * | 3/1998 | Vandromme et al. | 132/218 |
| 5,937,869 | * | 8/1999 | Lhuisset | 132/218 |
| 6,026,823 | * | 2/2000 | Gueret | 132/218 |

OTHER PUBLICATIONS

PCT WO94/143357 Dirksing, Dual wiper mascara package having residual chamber with bypass channel, Jul. 4, 1994.*

* cited by examiner

*Primary Examiner*—John J. Wilson
*Assistant Examiner*—Robyn Kieu Doan
(74) *Attorney, Agent, or Firm*—Bachman & LaPointe, P.C.

(57) ABSTRACT

A cosmetic dispenser, includes an applicator having an applicator portion and a cap portion, the cap portion having an inwardly facing screw thread; a container member having a body portion defining a product reservoir and having a neck portion extending from the body portion to receive the applicator, the neck portion having an outwardly facing screw thread for threadedly engaging the inwardly facing screw thread; and a smooth-walled thread guide portion extending from one screw thread of the inwardly facing screw thread and the outwardly facing screw thread toward an opposing screw thread of the inwardly facing screw thread and the outwardly facing screw thread, the thread guide portion being sized to slidingly engage the opposing screw thread so as to guide the opposing screw thread to the one screw thread in proper alignment for threaded engagement.

11 Claims, 2 Drawing Sheets

COSMETIC DISPENSER

BACKGROUND OF THE INVENTION

The invention relates to a cosmetic dispenser and, more particularly, to a mascara applicator having a simple and cost-effective structure which is nevertheless simple and easy to use and therefore consumer-friendly.

Cosmetic application arts are extremely well known, and applicators or dispensers for applying cosmetics such as facial mascara are numerous. Many of these devices are complex and therefore expensive to manufacture. One trend has been toward more simple and less expensive dispensers, particularly toward dispensers which can be used as product samplers.

One example of an attempt to provide a simple mascara dispenser is illustrated in U.S. Pat. No. 4,411,282 to Wavering. In this device, a simple bottle is provided having a cap and an applicator attached to the cap. In this device, the cap and applicator structure requires two separate injection-molded or otherwise formed parts and the bottle is a third part. In addition, the structure does not provide for ready alignment of threads between the cap and the container and therefore can easily become jammed when the cap is being placed upon the container. Further, the applicator structure itself requires a specific mechanical structure which adds to the cost of the device.

Despite the numerous disclosures in this art, the need remains for a simple, reliable and consumer-friendly cosmetic dispenser.

It is therefore the primary object of the present invention to provide a cosmetic dispenser which is inexpensive to manufacture.

It is a further object of the present invention to provide a cosmetic dispenser which is easy and reliable to use, and therefore consumer-friendly.

It is a still further object of the present invention to provide a cosmetic dispenser which is sufficiently simple and inexpensive to manufacture that it can readily be used as a sampler.

Other objects and advantages of the present invention will appear hereinbelow.

SUMMARY OF THE INVENTION

In accordance with the present invention, the foregoing objects and advantages have been readily attained.

According to the invention, a cosmetic dispenser is provided which comprises: an applicator having an applicator portion and a cap portion, said cap portion having an inwardly facing screw thread; a container member having a body portion defining a product reservoir and having a neck portion extending from said body portion to receive said applicator, said neck portion having an outwardly facing screw thread for threadedly engaging said inwardly facing screw thread; and a smooth-walled thread guide portion extending from one screw thread of said inwardly facing screw thread and said outwardly facing screw thread toward an opposing screw thread of said inwardly facing screw thread and said outwardly facing screw thread, said thread guide portion being sized to slidingly engage said opposing screw thread so as to guide said opposing screw thread to said one screw thread in proper alignment for threaded engagement.

The cap structure is also designed to allow for a single-piece manufacture for receiving a brush or applicator member while still allowing stable resting of the dispenser on its cap.

BRIEF DESCRIPTION OF THE DRAWINGS

A detailed description of preferred embodiments of the invention follows, with reference to the attached drawings wherein.

DETAILED DESCRIPTION

The invention relates to a cosmetic dispenser which is easy to use, inexpensive to manufacture, and therefore extremely consumer-friendly.

Figure 1:
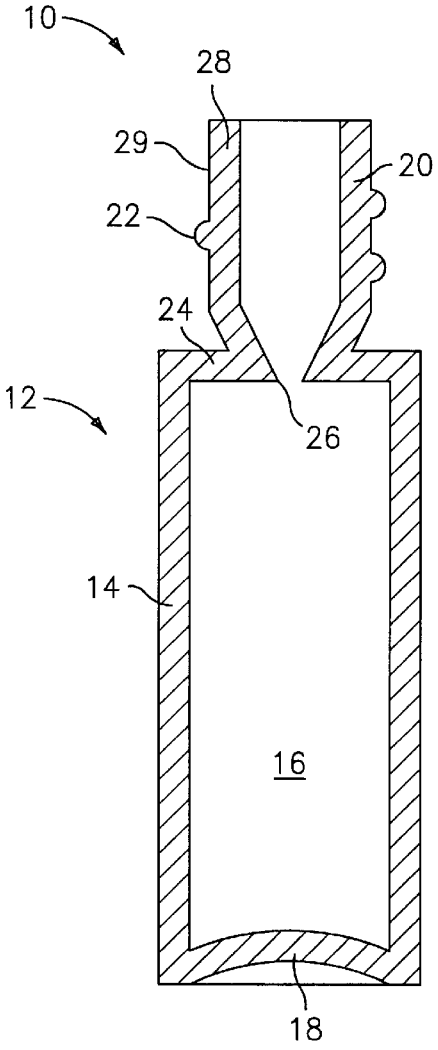
FIG. 1 is a side sectional view of a container portion of the cosmetic dispenser of the present invention.
Figure 2:
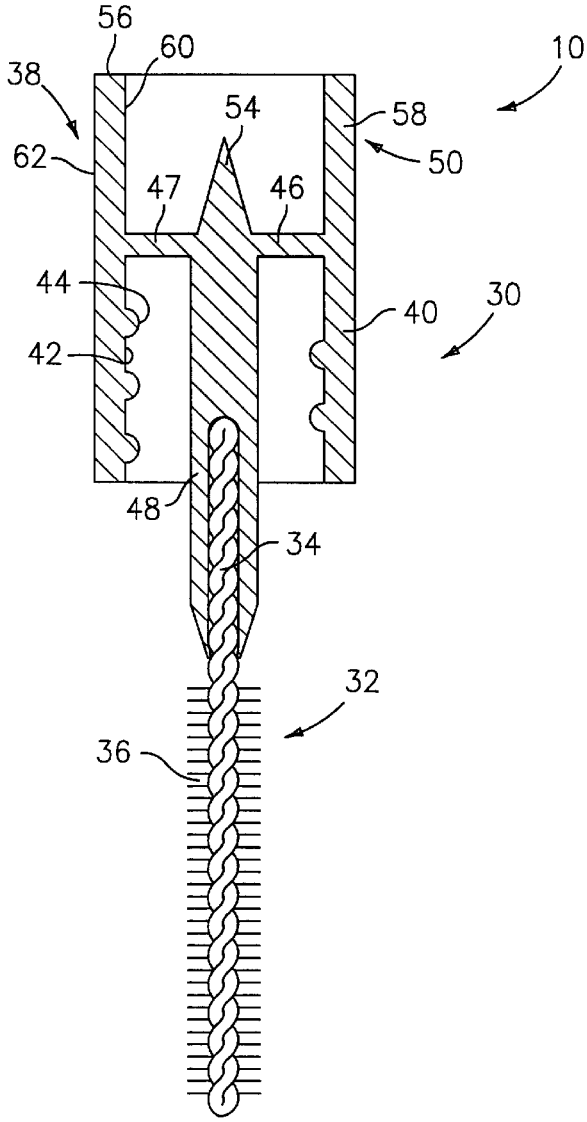
FIG. 2 is a side sectional view of the applicator portion of the cosmetic dispenser of the present invention.

FIGS. 1 and 2 illustrate the cosmetic dispenser of the present invention which will be referred to herein generally by the reference numeral 10. Dispenser 10 includes a container member 12 having a preferably substantially cylindrical-shaped wall member 14 defining a space 16 for holding a product such as a cosmetic, most preferably a facial mascara. Container 12 also has a bottom wall 18 for closing off the bottom of the container.

Container 12 includes a neck portion 20 which extends upwardly from wall member 14 and has defined thereon an outwardly facing screw thread 22. Container 12 may preferably have a shoulder portion 24 which extends inwardly a distance from wall member 14, and neck portion 20 preferably extends upwardly from shoulder portion 24. Further, container 12,is preferably manufactured so as to define an inwardly facing orifice or circular ridge 26 which acts as a wiper for removing excess material from the applicator portion as will be discussed below. Neck portion 20 also further includes a substantially cylindrical extension 28 which extends upwardly, away from wall member 14, so as to define an outwardly smooth-walled thread guide portion or surface 29 also as will be discussed further below.

Turning to FIG. 2, an applicator member 30 in accordance with the present invention is illustrated. Applicator member 30 includes an applicator portion 32 which may suitably be formed of a twisted wire member 34 having conventional bristles 36 extending radially therefrom. Bristles 36 preferably extend sufficiently that wiper 26 removes excess material as applicator portion 32 is removed from container 12, thereby leaving a desired amount of product on bristles 36 for application to a desired location. Applicator member 30 also includes a cap portion 38 for supporting applicator portion 32 and for engaging neck portion 20 of container 12.

Cap portion 38 preferably includes a substantially cylindrical or sleeve-shaped member 40 defining an inwardly facing surface 42 on which is disposed an inwardly facing screw thread 44 for threadedly engaging outwardly extending screw thread 22. Cap portion 38 preferably further includes a central member 46 extending inwardly from inner surface 42 to substantially close cap portion 38, and also preferably further includes a support member 48 downwardly extending from central member 46 for securely holding and supporting wire 34 of applicator portion 32. Support member 48 is preferably a substantially cylindrical or sleeve-shaped member and is sized on an exterior dimension to fit readily through circular ridge or wiper 26. Support member 48 may suitably define a blind hole for securely receiving end 52 of wire member 34 which may during manufacturing be heated and then positioned in the blind hole of member 48.

Cap portion 38 preferably includes an upwardly extending substantially cylindrical or sleeve-shaped member 50 which extends upwardly from central member 46, away from member 40 and in an opposite direction from applicator member 30.

It may be desirable during manufacture of cap portion 38 to leave a gate or other protruding structure. This may be desirable depending upon the tooling used and various other factors. In the structure of cap portion 38, it may be desirable to position or leave a gate 54 on the outer surface 47 of central member 46. This positioning of gate 54 would normally interfere with use of the top surface of the cap as a support for supporting either the applicator member 30 or entire dispenser 10 thereon. In accordance with the present invention, upwardly extending member 50 extends a greater distance than gate 54 so as to define a substantially flat support surface 56 which can advantageously be used as described above to support applicator member 30 and/or dispenser 10 on its cap on a flat surface. As shown in FIG. 2, this structure advantageously calls for upwardly extending member 50 to have a wall member 58 which extends upwardly from central member 46 so as to define both inner 60 and outer 62 substantially cylindrical surfaces, and also serves to define a convenient handle for use during application of product.

Figure 3:
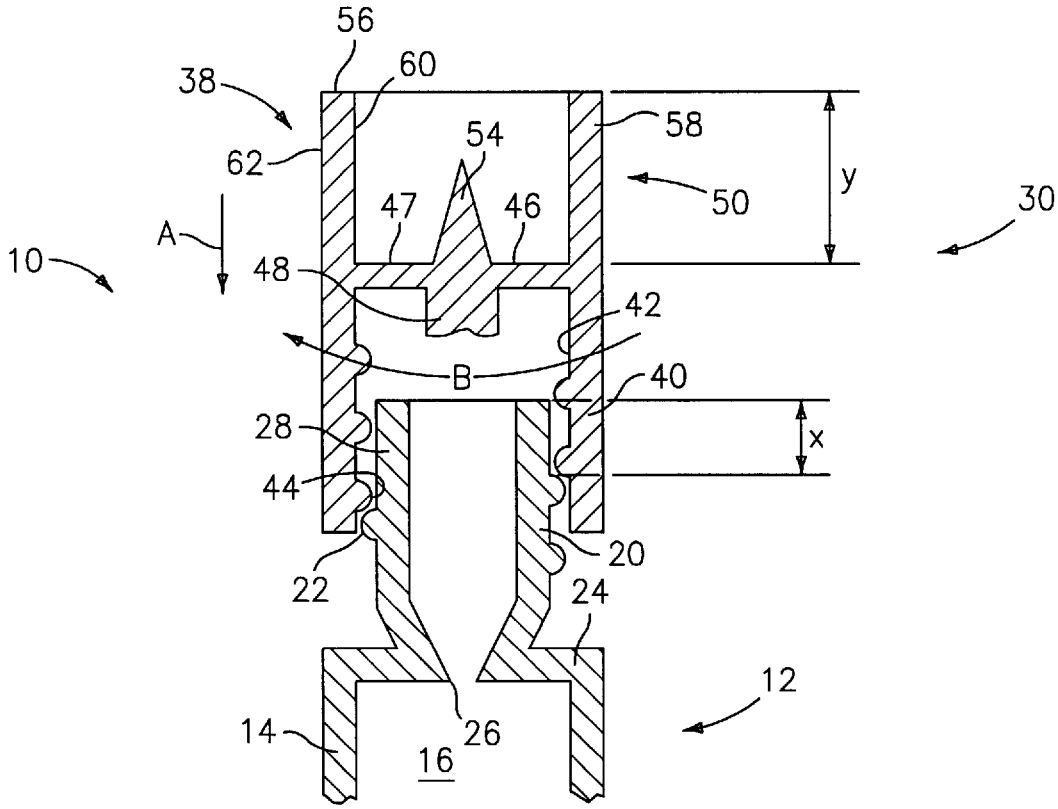
FIG. 3 is a sectional view of a portion of the container and cap in accordance with the present invention.

Turning now to FIG. 3, the advantageous interaction between applicator member 30 and container 12 is further illustrated.

As described above, container 12 preferably has neck portion 20 including extension 28 having a substantially smooth outer wall surface 29 which serves as a thread guide. This extension is preferably positioned extending upwardly from the upper-most outwardly facing screw thread 22 an advance distance X which is at least as great as the advance of one 360° turn of inwardly facing screw threads 44 of cap portion 38. In addition, extension member 28 is preferably provided having an outside diameter which is sized relative to the inside diameter of the inward most edge of inwardly facing screw threads 44 such that thread guide extension 28 snugly and slidably receives cap portion 38 with inwardly facing screw threads 44 snugly sliding thereon. The outside diameter is preferably slightly smaller than but within about 0.5 mm in size as compared to the inside diameter of inwardly facing screw threads 44. Sliding of cap portion 38 relative to container 12 in the direction illustrated by arrow A results in a sliding engagement which correctly aligns inwardly facing screw threads 44 and outwardly facing screw threads 22 for proper threaded or rotating engagement. This advantageously eliminates the possibility for mis-alignment of the screw threads resulting in a jamming of the cap relative to the container. Clearly, this provides a far more consumer-friendly device which is easier and certainly less potentially frustrating in use. Once cap portion 38 is downwardly disposed relative to container 12 as illustrated by arrow A to the position shown in FIG. 3, rotation of cap portion 38 relative to container 12, for example as shown by arrow B, serves to engage the threads of the respective cap portion 38 and container 12 to securely and reliably close the device. Absent thread guide 28, jamming could occur such as that which is allowed in the afore-described U.S. Pat. No. 4,411,282 to Wavering.

Figure 4:
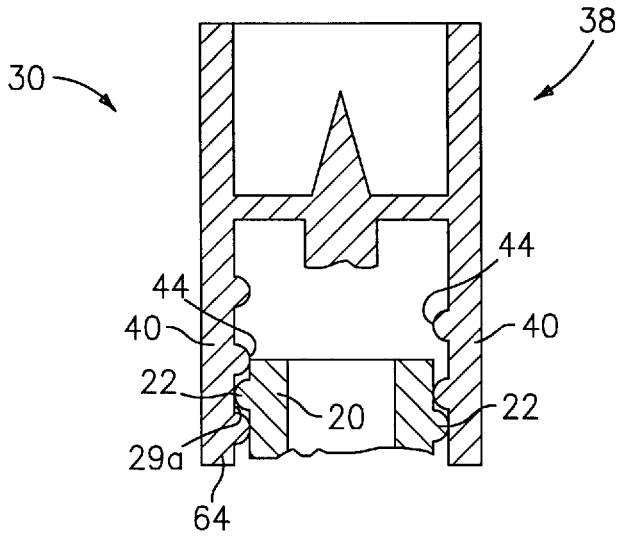
FIG. 4 illustrates an alternative embodiment of the invention.

It should be noted that although the preferred configuration of positioning of thread guide surface 29 is illustrated in FIGS. 1–3, a thread guide surface 29*a* (FIG. 4) could also be positioned on an inner surface of extension 64 extending downwardly from member 40 of cap portion 38. In this embodiment, thread guide surface 29*a* would interact with threads 22 to perform the same function and benefits as indicated in connection with FIGS. 1–3. Either way, the tolerance between these surfaces is preferably less than or equal to about 0.5 mm to ensure a snug fit and proper thread guiding function.

Referring back to FIG. 3, the upward extension of upwardly extending member 50 beyond the upper surface 47 of central member 46 is illustrated at distance Y, and this distance Y is preferably greater than the distance of extension of gate 54 as discussed above in connection with FIG. 2 for the advantageous reasons set forth therein.

Container 12 in accordance with the present invention is preferably provided in a single injection or blow-molding procedure which thereby greatly simplifies the manufacture thereof, resulting in a significant reduction in cost.

Cap portion 38 of applicator member 30 is also preferably a single injection or blow-molded part which provides the same benefits as with container 12.

The materials from which the components of the present invention are manufactured are readily known to the person of ordinary skill in the art. In addition, the specific cosmetic preparation to be dispensed from container 12 is also readily known to the person of ordinary skill in the art.

From a consideration of the foregoing, it should be readily appreciated that a cosmetic dispenser has been provided which is inexpensive to manufacture, and which is extremely consumer-friendly in use. This device is extremely well suited for use as a sampler for low-cost or free giveaway or other promotional use to introduce consumers to particular types of cosmetics.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A cosmetic dispenser, comprising:

an applicator having an applicator portion and a cap portion, said cap portion having an inwardly facing screw thread;

a container member having a body portion defining a product reservoir and having a neck portion extending from said body portion to receive said applicator, said neck portion having an outwardly facing screw thread for threadedly engaging said inwardly facing screw thread; and a smooth-walled thread guide portion extending from one screw thread of said inwardly facing screw thread and said outwardly facing screw thread toward an opposing screw thread of said inwardly facing screw thread and said outwardly facing screw thread, said thread guide portion being sized to slidingly engage said opposing screw thread so as to guide said opposing screw thread to said one screw thread in proper alignment for threaded engagement, wherein said thread guide portion has a diameter and said opposing screw thread has an opposing diameter, and wherein said diameter is within about 0.5 mm of said opposing diameter in size.

2. A cosmetic dispenser according to claim 1, wherein said thread guide portion is an outwardly facing surface extending from said outwardly facing screw thread away from said body portion and sized to slidingly engage said inwardly facing screw thread.

3. A cosmetic dispenser according to claim 1, wherein said thread guide portion extends a distance which is greater than or equal to an advance distance corresponding to a single 360° rotation of said opposing screw thread.

4. A cosmetic dispenser according to claim 1, wherein said container member is a single piece defining said body portion and said neck portion.

5. A cosmetic dispenser according to claim 1, wherein said container member further includes an inwardly extending wiper for wiping excess material from said applicator portion.

6. A cosmetic dispenser according to claim 5, wherein said wiper is defined between said body portion and said neck portion.

7. A cosmetic dispenser according to claim 1, wherein said cap portion comprises a sleeve defining said inwardly facing screw thread, a central member closing said sleeve, and a support member extending from said central member to support said applicator portion.

8. A cosmetic dispenser according to claim 7, wherein said central member includes a gate extending from an outside surface of said central member, and wherein said cap portion further includes a support sleeve portion extending from said central portion away from said sleeve defining said inwardly facing screw thread, said support sleeve portion extending a distance which is greater than said gate.

9. A cosmetic dispenser, comprising:

an applicator having an applicator portion and a cap portion, said cap portion having an inwardly facing screw thread;

a container member having a body portion defining a product reservoir and having a neck portion extending from said body portion to receive said applicator, said neck portion having an outwardly facing screw thread for threadedly engaging said inwardly facing screw thread; and a smooth-walled thread guide portion extending from one screw thread of said inwardly facing screw thread and said outwardly facing screw thread toward an opposing screw thread of said inwardly facing screw thread and said outwardly facing screw thread, said thread guide portion being sized to slidingly engage said opposing screw thread so as to guide said opposing screw thread to said one screw thread in proper alignment for threaded engagement;

wherein said cap portion further comprises a sleeve defining said inwardly facing screw thread, a central member closing said sleeve, and a support member extending away from said central member in a direction opposite to said sleeve so as to define a support surface for supporting said applicator portion.

10. A cosmetic dispenser according to claim 9, wherein said central member further includes an extending member extending from an outside surface of said central member, and wherein said support member comprises a support sleeve portion extending from said central portion away from said sleeve, said support sleeve portion extending a distance which is greater than said extending member.

11. A cosmetic dispenser according to claim 9, wherein said support member comprises a substantially cylindrical wall extending from said central member in a direction opposite to said applicator portion and having a substantially flat end face.

* * * * *